US006101748A

United States Patent [19]

Cass et al.

[11] Patent Number: 6,101,748

[45] Date of Patent: Aug. 15, 2000

[54] COMPOSITE PANELLING MATERIALS FOR DISPLAYING BACK-LIT GRAPHICS AND COLORS

[76] Inventors: S. Thornton Cass, 22 Burgess Drive, Grimsby, Ontario, Canada, L3M 2Y9; James R. Leach, 894 Upper Wellington, Hamilton, Ontario, Canada, L9A 3S1

[21] Appl. No.: 09/190,458

[22] Filed: Nov. 13, 1998

[30] Foreign Application Priority Data

Jan. 28, 1998 [CA] Canada ..... 2228057

[51] Int. Cl.[7] ..... G09F 13/12

[52] U.S. Cl. ..... 40/219; 40/564

[58] Field of Search ..... 40/564, 568, 572, 40/716, 615, 427, 219, 544; 362/812

[56] References Cited

U.S. PATENT DOCUMENTS

| | | | |
|---|---|---|---|
| 2,958,762 | 11/1960 | Cheney | 40/544 X |
| 3,188,761 | 6/1965 | Harrold | 40/544 |
| 3,284,941 | 11/1966 | Kaup | 40/544 |
| 3,404,474 | 10/1968 | Johnson | 40/544 |
| 3,510,976 | 5/1970 | Pauline et al. | 40/564 |
| 3,680,237 | 8/1972 | Finnerty, Sr. | 40/544 |
| 3,978,599 | 9/1976 | Berger | 40/564 X |
| 4,005,538 | 2/1977 | Tung . | |
| 4,195,431 | 4/1980 | Neufeld | 40/544 |
| 4,447,860 | 5/1984 | Stone et al. . | |
| 4,457,089 | 7/1984 | Phillips, Jr. | 40/544 |
| 4,568,102 | 2/1986 | Dauvergne . | |
| 5,443,869 | 8/1995 | Harris . | |
| 5,544,020 | 8/1996 | Loeber et al. . | |

*Primary Examiner*—Terry Lee Melius
*Assistant Examiner*—William L. Miller
*Attorney, Agent, or Firm*—Ridout & Maybee

[57] ABSTRACT

A composite panel material for the back-lit display of graphic and alphanumeric designs and color fields as disclosed which includes regions that appear metallic and highly reflective when front-lit but which when back-lit transmit a portion of the back-lighting to give a "see-through metal" effect. Panelling material according to the design comprises a transparent base medium, daytime design images which are visible when the panel material is front- but not back-lit, and a partially reflective metallized element which appears opaque and shiny when front- but not when back-lit, of a pre-selected degree of transparency to permit the viewing of one set of images and colors in front-lighting and a different set under back-lighting of the panel material.

6 Claims, 2 Drawing Sheets

COMPOSITE PANELLING MATERIALS FOR DISPLAYING BACK-LIT GRAPHICS AND COLORS

The present invention relates to composite panelling materials for the display of graphics in instrument consoles, signage and other applications involving indication and identification, in which the graphics display seen by viewing the front surface under front-lighting differs from the back-lit graphics.

The most common current example of "changeable graphics" is afforded by instrument panels which include such elements as warning lights and symbols that clearly appear when the panel is back-lit but disappear from view entirely when the panel is only front-lit and not back-lit. Such "deadfront" graphics almost always appear black in ordinary light.

A typical example of deadfront graphics is afforded by the tractor dashboard of U.S. Pat. No. 4,447,860 (Stone et al.) which includes printed flat translucent sheets bonded over an apertured surface, such that symbols or indicia printed on the undersurface of the sheets in such a manner that some of the indicia are visible at all times while others are virtually invisible except when back-lit by a light-emitting device included in the dashboard of the tractor.

It is an object of the present invention to provide panelling materials for graphic back-lit instrumentation, indicators, identification and signage which may be decorated in one or more other colours, to improve graphics and increase the number of design opportunities, and in which a viewing surface that appears reflective and metallic (chrome, gold, etc.) when front-lit can transmit a portion of back-lighting so as to allow back-lit colours and graphics to appear through the metallic portion.

With a view to achieving this object and other advantages that will appear from a reading of the specification as a whole, we have found that a variety of inks and/or films of selected transparency and colour can be applied to either or both sides of a transparent base medium and a semi-reflective metallic layer can be positioned to either side of the base medium through metallic deposition or by lamination to the medium of metallized film. Judicious selection of the various inks and films used for their degree of opacity enables various back-lit colours and graphics to appear through the non-back-lit graphics, including through the metallic portions.

BRIEF DESCRIPTION OF THE DRAWINGS

In each of the drawing figures, there is shown in exploded cross-section a composite panelling material which includes as its essential elements a clear medium 3, "daytime" graphics 2 (i.e., graphics viewed when the material is not back-lit), and partially reflective metallized element 4. In FIGS. 1*a* to 1*c*, the metallized element 4 is disposed in front of clear medium 3, while in FIGS. 2*a* to 2*c* element 4 is to the rear, i.e., closer to a source of back-lighting, than element 3. "Nighttime" graphics 6, viewed only when back-lit, may be disposed behind the daytime graphics. The variants a, b and c in FIG. 1 and FIG. 2 are indicative of the fact that the graphics 2 and 6 can be positioned to either or to both sides of the clear medium 3.

The clear base medium 3 may be any of a number of clear molded resins or commercially available films such as MYLAR (trade-mark) or LEXAN (trade-mark), with physical characteristics appropriate to the end use of the display panelling.

The daytime graphics indicated as 2 may consist of any number of colours or images depending on the finished design that is required. Inks painted directly onto clear medium 3 or onto separate films are of an opacity chosen to avoid the appearance of "ghost" images in use. The night-time graphics 6 may likewise consist of any number of colours and images dependent on the finished back-lit design required.

Figure 1:
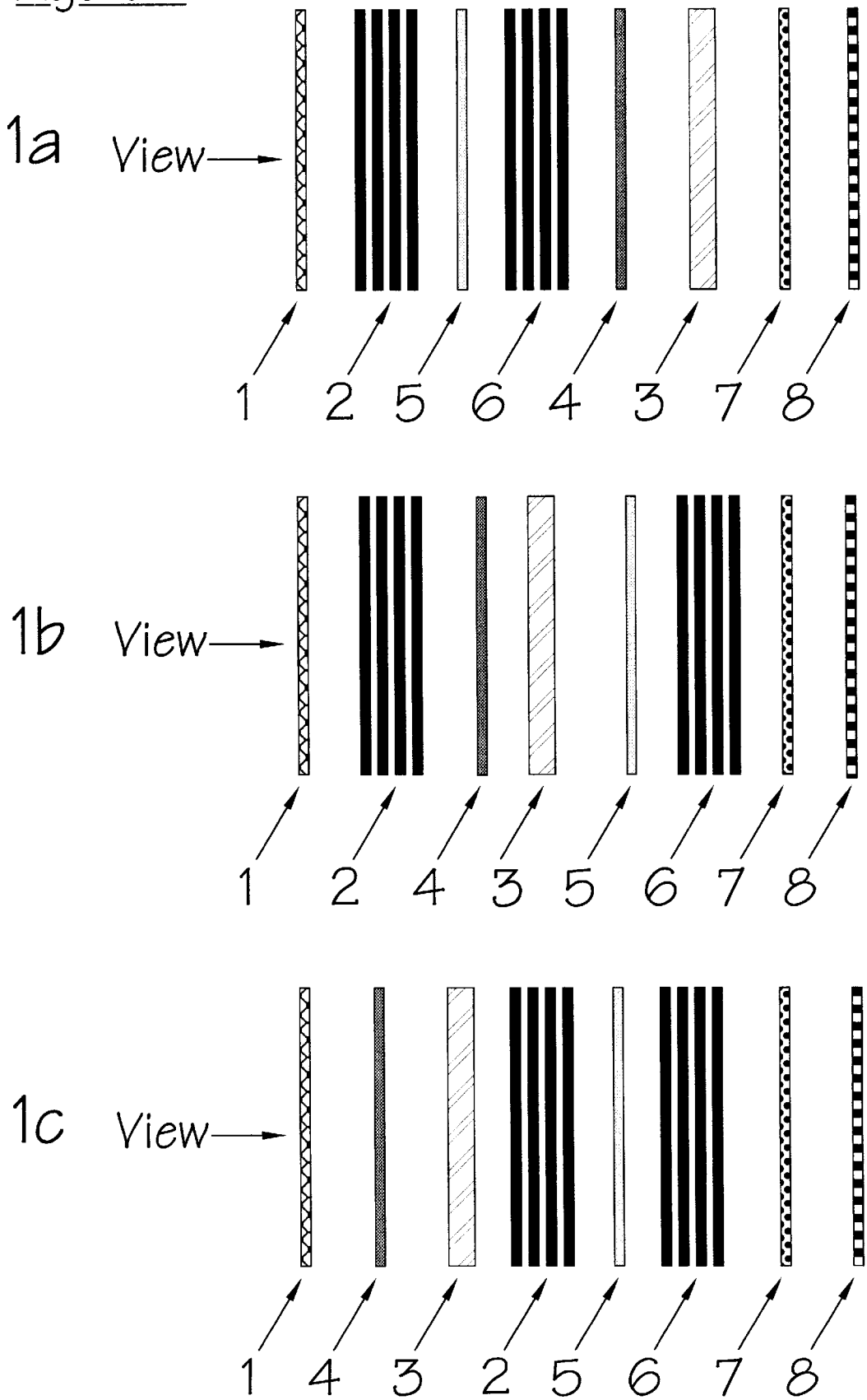
FIGS. 1*a* to 1*c* and 2*a* to 2*c* are schematic exploded cross-sectional views of six variant arrangements of component layers in a panel of composite material according to the invention, the "View" arrow in each case pointing to the front surface of the composite material.

The composites of drawing FIGS. 1*a* to 1*c* also include the following optional features, from the front to the rear of the cross-section:

- component film 1 schematically illustrates optional "add-ons", i.e., commonly used surface treatments such as decorative and/or protective coatings;
- reference numeral 5 indicates a "barrier coat", an optional application of patterned opaque ink or film. The pattern of the barrier coat is chosen to correspond with the graphics and the desired effect provided by the visible surface, with opaque areas of the barrier coat preventing unwanted illumination of the visible surface when the product is back-lit. Openings into or clear areas within the barrier coat may be provided to allow illumination of specific areas of the visible surface when the product is back-lit;
- reference numeral 7 indicates another layer of optional "add-ons", in particular protective surface coatings; and
- reference numeral 8 refers to an optional mounting layer, which may be required for final assembly in a particular use of the composite. The mounting layer 8 may have surface adhesives, application tapes or appropriate fixtures for mounting.

By adjusting and regulating for varying degrees of opacity of the inks and/or films used in the composite, the back-lit graphics appear through the non-back-lit graphics, and many striking and appealing effects can be achieved. According to the present invention, schematically illustrated in FIGS. 2*a* to 2*c*, laminate materials when back-lit may now allow a product to be illuminated directly through chrome, gold and other metallic colours heretofore considered opaque.

Figure 2:
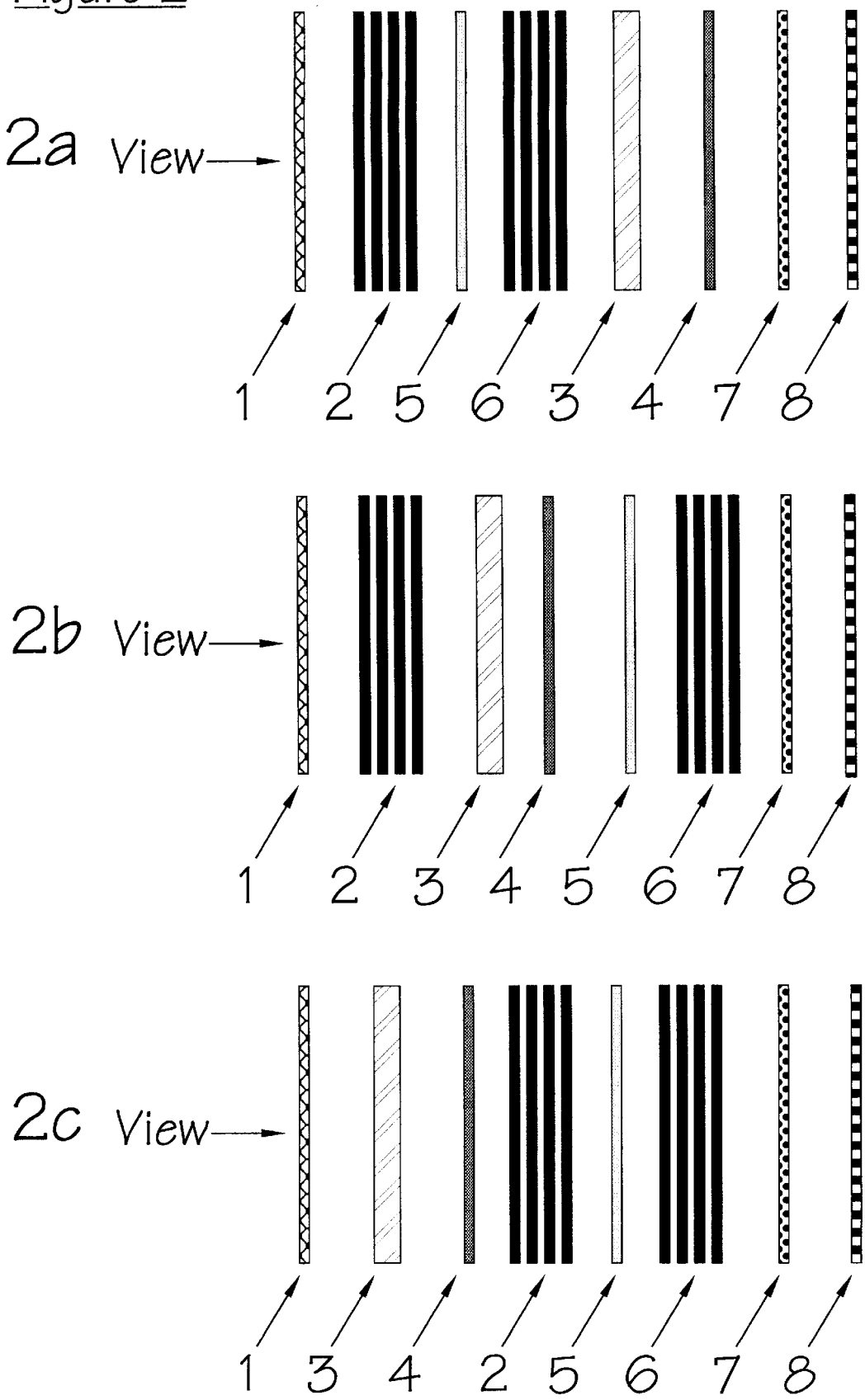

The variants of FIGS. 2*a* to 2*c* are comparable to those of FIGS. 1*a* to 1*c*, except for the disposition of the metallized element 4 relative to clear medium 3 and a source of back-lighting (not shown) coming from the right in the figures as presented. The addition of the metallized layer, either through deposition or film lamination, to either side of the clear medium causes the finished product to appear metallic when not back-lit.

Selective control of the degree of opacity for optimum desired end use allows the addition of semi-transparent metallization to impart chrome, gold and other metallic colours while still permitting back-lit nighttime graphics to appear through the daytime graphics. Further the use of such semi-transparent metallics without incorporating any night-time graphics allows for back-lit illumination of the product directly through the chrome, gold or metallic areas, with a visually striking "see-through metal" effect.

Semi-transparent metallized films have been used and are commercially available as, for example, "solar film", a partly reflective metallized MYLAR (trade-mark) film. These can be made in a wide range of opacities suitable for different back-lit systems employing composites of the present invention.

We claim:

1. A composite panel material for the display, by back-lighting, of graphic and alphanumeric designs and color fields, through regions of said panel material which appear metallic and highly reflective when front-lit, comprising:

(a) a transparent panel base medium having a front surface and a back surface;

(b) daytime designs, consisting of images and color applied to either of said surfaces of the base medium or to a separate transparent film disposed in use parallel to a surface of said base medium, said daytime designs being visible when said panel material is front-lit, but not when said panel material is back-lit; and (c) a partially reflective metallized element, comprising metallized film-form material laminated to a principal surface of said base medium and being of a selected degree of transparency to allow a portion of back-lighting to pass through said metallized element and be visible from the front of the panel material as illumination of the element.

2. A composite panel material according to claim 1, further comprising nighttime designs consisting of images and color applied to either surface of said base medium, or to a separate transparent film disposed in use parallel to a surface of said base medium, said nighttime designs being visible only when said panel material is back-lit.

3. A composite panel material according to claim 1 or claim 2, wherein said transparent panel base medium is a sheet of glass.

4. A composite panel material according to claim 1 or claim 2, wherein said transparent panel base medium is selected from the group consisting of polyester films and polycarbonate films.

5. A composite panel material according to claim 1 or claim 2, wherein said transparent panel base medium is selected from films made of Mylar™ or Lexan™.

6. A composite panel material according to claim 1, further comprising a barrier layer interposed between a source of back-lighting and said daytime designs, said barrier layer including therein transparent regions to permit transmission of back-lighting through specific portions of said panel material.

* * * * *